US009928670B2

(12) United States Patent
Zhao

(10) Patent No.: US 9,928,670 B2
(45) Date of Patent: Mar. 27, 2018

(54) METHOD AND SYSTEM FOR ACCESS CONTROL MONITORING

(71) Applicant: GOERTEK INC., Weifang (CN)

(72) Inventor: Peijie Zhao, Weifang (CN)

(73) Assignee: GOERTEK INC., Weifang (CN)

( * ) Notice: Subject to any disclaimer, the term of this patent is extended or adjusted under 35 U.S.C. 154(b) by 0 days.

(21) Appl. No.: 15/517,336

(22) PCT Filed: Jun. 23, 2016

(86) PCT No.: PCT/CN2016/086936

§ 371 (c)(1),
(2) Date: Apr. 6, 2017

(87) PCT Pub. No.: WO2017/107418

PCT Pub. Date: Jun. 29, 2017

(65) Prior Publication Data

US 2018/0047226 A1 Feb. 15, 2018

(30) Foreign Application Priority Data

Dec. 24, 2015 (CN) ..... 2015 1 1002952

(51) Int. Cl.
*G07C 9/00* (2006.01)

(52) U.S. Cl.
CPC ..... *G07C 9/00071* (2013.01); *G07C 9/00111* (2013.01); *G07C 9/00119* (2013.01); *G07C 9/00103* (2013.01)

(58) Field of Classification Search
CPC ..... G07C 9/00071; G07C 9/00111; G07C 9/00119; G07C 9/00103
(Continued)

(56) References Cited

U.S. PATENT DOCUMENTS

2008/0224859 A1 9/2008 Li
2014/0162598 A1* 6/2014 Villa-Real ..... H04M 1/66 455/411
2016/0012445 A1* 1/2016 Villa-Real ..... G06Q 20/32 705/44

FOREIGN PATENT DOCUMENTS

CN 201965672 U 9/2011
CN 102306412 A 1/2012
(Continued)

OTHER PUBLICATIONS

International Search Report and Written Opinion dated Sep. 30, 2016 for PCT Application No. PCT/CN2016/086936.

*Primary Examiner* — Allen T Cao
(74) *Attorney, Agent, or Firm* — Moser Taboada

(57) ABSTRACT

The present disclosure discloses a method and system for access control monitoring. The method includes: matching with a mobile terminal on a user's side provided with function of short-range wireless communication, and establishing a verification list recording the user identity information; when the monitoring function is on, controlling the access control terminal to identify a mobile terminal within a monitored region; when the mobile terminal is identified, verifying user identity information of the user to which the mobile terminal belongs; when the verification of the user identity information is approved, locating the user to which the mobile terminal belongs; for a successfully located user, activating a voice recognition mode, controlling the access control terminal to play identification prompt sounds to the user and verifying the identity of the user by user responding voice returned by the access control terminal, and controlling opening or closing of the access control based on the voice verification result. Compared with existing verification methods of touch-type and of human face type, the technical solutions in the present disclosure are more con-
(Continued)

venient and safer, and can effectively enhance the user's experience.

15 Claims, 3 Drawing Sheets

(58) Field of Classification Search
USPC ..... 340/5.5–5.55
See application file for complete search history.

(56) References Cited

FOREIGN PATENT DOCUMENTS

| | | | |
|---|---|---|---|
| CN | 104063931 | A | 9/2014 |
| CN | 105654584 | A | 6/2016 |
| EP | 1120752 | A1 | 8/2001 |

* cited by examiner

METHOD AND SYSTEM FOR ACCESS CONTROL MONITORING

TECHNICAL FIELD

The present disclosure relates to the technical field of access control, in particular, relates to a method and system for access control monitoring.

BACKGROUND

At present, domestic access control systems perform identity verification mainly by card-type devices, finger print and human face identification technology.

However, card-type devices can be easily lost and forgotten, and thus it is not only inconvenient for identity verification, but also imposes security risks. If a person with a bad intention obtains the card, he may implement theft. Current access control systems often adopt fingerprint identification and human face identification. Fingerprint identification can overcome the defects of the card-type products. However, around 5% people cannot be identified by fingerprints, and such identification methods by touching can spread infection easily. Furthermore, during season changes or dry seasons, fingerprint identification also has the problem of requiring several attempts so that the identification can be successfully done. The human face identification is limited by light, postures and accessories. When performing human face comparison, the facts that the user got shaved, is wearing eye-glasses or has an expression change may lead to the failure of the identification by the system and great inconvenience to the user identity verification.

SUMMARY

In view of those problems, the present disclosure provides a method and system for access control monitoring so as to enhance the convenience and security of user identity verification.

In order to achieve the above objects, the technical solutions of the present disclosure are realized as follows:

In one aspect, the present disclosure provides a method for access control monitoring, suitable for a control region including a plurality of rooms. Each room is provided with an access control terminal. The method for access control monitoring comprises:

- matching with a mobile terminal on a user's side provided with function of short-range wireless communication, and establishing a verification list recording user identity information;
- when monitoring function is on, controlling the access control terminal to identify the mobile terminal within the monitored region by short-range wireless communication function of the mobile terminal;
- when the mobile terminal is identified, verifying the user identity information of the user to which the mobile terminal belongs;
- when the verification of the user identity information is approved, locating the user to which the mobile terminal belongs; and
- for a successfully located user, activating a voice recognition mode, controlling the access control terminal to play identification prompt sounds to the user and verifying the identity of the user by the user responding voice returned by the access control terminal, and controlling opening or closing of the access control based on the voice verification result.

In another aspect, the present disclosure also provides a system for access control monitoring, suitable for a control region including a plurality of rooms. The system for access control monitoring includes an access control terminal provided in each room and an access control monitoring server. The access control monitoring server comprises:

- a matching unit for matching with a mobile terminal on a user's side provided with function of short-range wireless communication and establishing a verification list recording the user identity information;
- an identification unit for, when the monitoring function is on, controlling the access control terminal to identify a mobile terminal within the monitored region by short-range wireless communication function of the mobile terminal;
- a verification unit for, when the mobile terminal is identified, verifying user identity information of the user to which the mobile terminal belongs;
- a locating unit for, when the verification of the user identity information is approved, locating the user to which the mobile terminal belongs; and
- a voice identity verification unit for activating a voice recognition mode for the successfully located user, wherein the access control terminal is controlled to play identification prompt sounds to the user and the user identity is verified by the user responding voice returned by the access control terminal, and controlling opening or closing of the access control based on the voice verification result.

The beneficial effect of the present embodiments is that: the present disclosure combines the functions of the short-range wireless communication and voice recognition to replace the traditional verification methods for access control such as swiping cards, fingerprints or human face identification. By short-range wireless communication function in the mobile terminal, a user's mobile terminal can be detected and located without the user's perception. When the mobile terminal is successfully identified and the user to which the mobile terminal belongs arrives at a target zone, the voice recognition mode is activated. The user's identity is verified by means of automatic voice recognition.

Compared with existing verification methods of touch-type (such as swiping cards or fingerprints) and of human face type, the verification method for the user's identity in the present disclosure is more convenient and safer, and can effectively enhance the user's experience.

BRIEF DESCRIPTION OF THE DRAWINGS

The drawings are intended to provide further understanding of the present disclosure and constitute part of the description. The drawings explain the present disclosure in combination with the embodiments of the present disclosure but in no way limit the present disclosure. In the drawings.

DETAILED DESCRIPTION

To make the objects, technical solutions and advantages of the present disclosure clear, embodiments of the present disclosure will be described in further detail in combination with the drawings.

Due to the features and advantages of low cost, low power consumption and peer-to-peer communication of short-range wireless communication technology, short-range wireless devices are very common, especially widely used in cell phones or wearable devices. The low power consumption feature of this function makes it possible that the mobile terminal of the user keeps transmitting wireless signals.

Voice recognition is also a very common method for identification. It distinguishes different users by the uniqueness of the specific voice information of user voices, such as tone or frequency.

Based on the above description, the whole concept of the present disclosure is: detecting and identifying the user location by short-range wireless communication function, activating a voice recognition mode when the user reach a target zone, and verifying the user's identity by automatic voice recognition, so as to control opening and closing of the access control.

Embodiment I

This embodiment provides a method for access control monitoring, suitable for a control region including a plurality of rooms. Each room in this control region is provided with an access control terminal.

Figure 1:
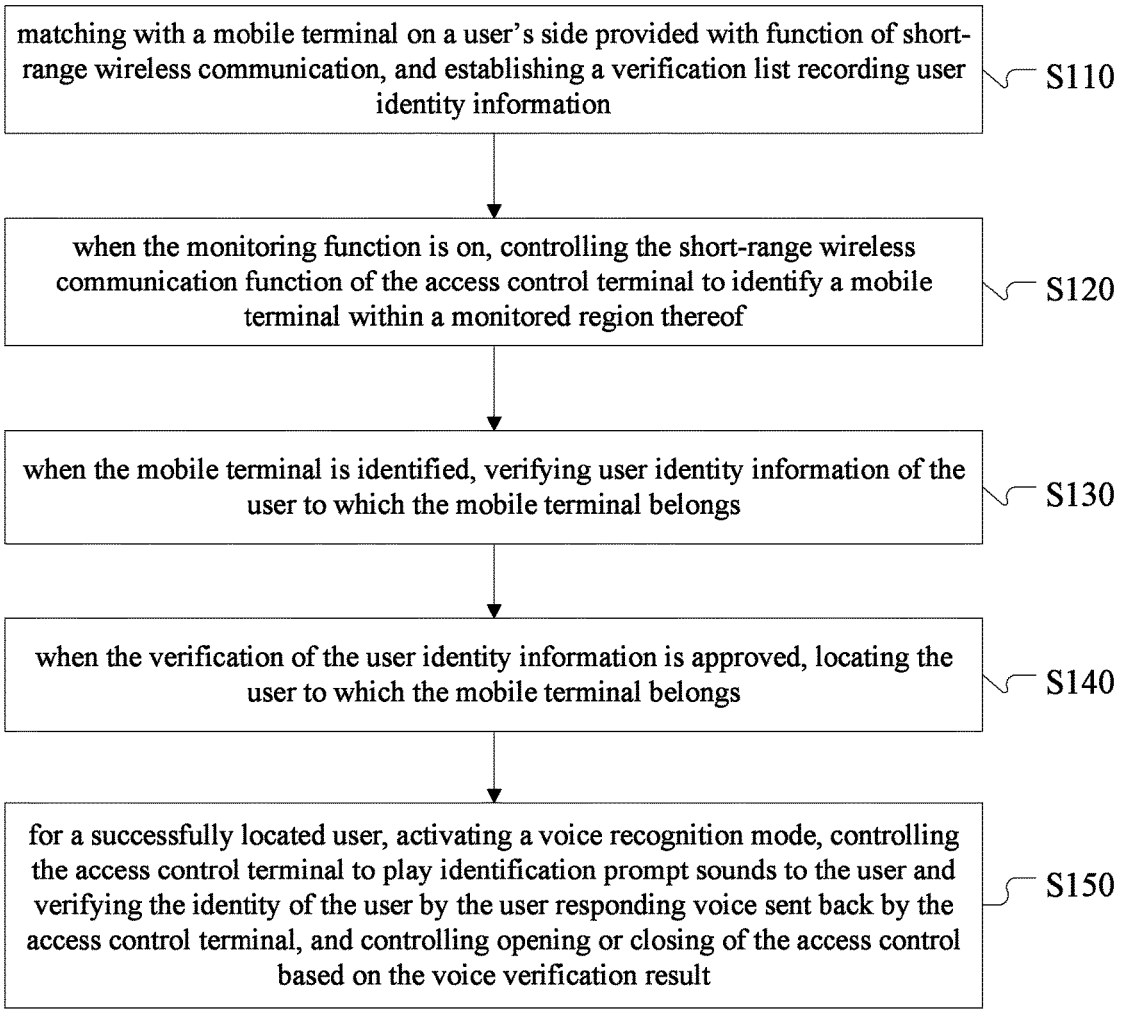
FIG. 1 is a flow diagram for a method for access control monitoring provided by Embodiment I of the present disclosure.

FIG. 1 is a flow diagram for a method for access control monitoring provided by the present embodiment of the present disclosure. As shown in FIG. 1, the method of FIG. 1 includes:

S110, matching with a mobile terminal on a user's side provided with function of short-range wireless communication, and establishing a verification list recording user identity information.

The short-range communication technology mainly includes Bluetooth Low Energy (BLE), ZigBee protocol, Near Field Communication (NFC) and Wireless Local Area Networks (WLAN). Due to the wide application of BLE technology, for example the BLE function on mobile devices such as cell phones and wristbands, this embodiment preferably adopts the BLE function of a mobile terminal to perform identity verification for the user to which it belongs. Of course, for a specific or particular place, it is also possible to perform identity verification for the user to which a mobile terminal belongs by the mobile terminal with the WLAN function, ZigBee function or NFC function.

The user identity information in step S110 includes an identifier for uniquely indicating the mobile terminal. The identifier is a Universally Unique Identifier (UUID) of the mobile terminal. UUID can guarantee that every device within same time and space is unique and can uniquely indicate the user to which the mobile terminal belongs.

It should be noted that when the mobile terminal in this embodiment is a mobile terminal with a BLE function, its identifier is a Bluetooth UUID. Because the standard UUID has a length of 128 bits, when applied in the mobile terminal with a BLE function, the 16-bit or 32-bit of the standard UUID is always used as base UUID for uniquely indicating the user.

S120, when the monitoring function is on, controlling the access control terminal to identify a mobile terminal within a monitored region by short-range wireless communication function of the mobile terminal.

S130, when the mobile terminal is identified, verifying user identity information of the user to which the mobile terminal belongs.

S140, when the verification of the user identity information is approved, locating the user to which the mobile terminal belongs.

S150, for a successfully located user, activating a voice recognition mode, controlling the access control terminal to play identification prompt sounds to the user and verifying the identity of the user by the user responding voice sent back by the access control terminal, and controlling opening or closing of the access control according to the voice verification result.

As an example, the above steps S110 to S150 can be carried out by an access control monitoring server.

The embodiment combines the short-range wireless communication function and voice recognition function to replace the traditional verification methods for access control such as swiping cards, fingerprints or human face identification. By short-range wireless communication function in the mobile terminal, a user's mobile terminal can be detected and located without the user's perception. When the mobile terminal is successfully identified and the user to which the mobile terminal belongs arrives at a target zone, the voice recognition mode is activated. The user's identity is verified by automatic voice recognition.

Compared with existing verification methods of touch-type (such as swiping cards or fingerprints) and of human face type, the verification method for the user's identity in this embodiment is more convenient and safer, and can effectively enhance the user's experience.

In one implementation of this embodiment, locating the user to which the mobile terminal belongs in the above step S140 includes:

identifying moving status of the mobile terminal;

then for a successfully located user, activating a voice recognition mode in the above step S150 is embodied as: when the moving status of the mobile terminal is entering into a room, activating the voice recognition mode and starting the voice verification; and when the moving status of the mobile terminal is exiting the room, controlling the access control terminal to open the access control and close the access control after the user leaves.

By identifying the moving status of the mobile terminal, the moving status of the user to which the mobile terminal belongs is determined based on the moving status of the mobile terminal. When the user to which the mobile terminal belongs wants to enter into the room, the voice recognition mode is activated; and when the user to which the mobile terminal belongs wants to leave the room, the access control is opened. Therefore, the access control terminal can be correspondingly controlled in accordance with the user's intent so as to enhance the user's experience.

In another implementation of this embodiment, the user identity information recorded in the verification list established in the step S110 includes an identifier for uniquely indicating the mobile terminal.

Then in the above S130, when the mobile terminal is identified, verifying user identity information of the user to which the mobile terminal belongs is embodied as:

obtaining the identifier of the mobile terminal from a wireless response signal transmitted by the mobile terminal, and if the identifier exists in the verification list, the verification of the user identity information of the user to which the mobile terminal belongs is approved; and if the identifier does not exist in the verification list, the verification of the user identity information of the user to which the mobile terminal belongs is not approved; and the wireless response signal is a feedback signal transmitted by the mobile terminal relative to the broadcasting signal transmitted by the access control terminal and the broadcasting signal is a signal sent by the access control terminal for identifying the mobile terminal.

Obviously, the user identity information recorded in the above verification list also includes user voice information.

Then the process of the voice verification of the above step S150 is:

controlling the access control terminal to play identification prompt sounds to the user and obtaining the user responding voice returned from the access control terminal; determining whether the obtained user responding voice is identical with the user voice information in the verification list; controlling the access control terminal to open the access control if they are identical; and controlling the access control terminal to keep the access control closed and informing the user of voice verification failure if they are not identical.

Furthermore, in consideration of the factors such as the application and management of the control access terminal, user authorities being verified may be different, that is, user identity information recorded in the verification list may also include user authority information.

When the user authority information is recorded in the verification list established in step S110, then in the step S150, for a successfully located user, activating the voice recognition mode also comprises:

obtaining the user authority information to which the identifier of the mobile terminal corresponds; and determining whether the voice recognition mode should be activated based on the user authority information to which the identifier corresponds; and if the user authority to which the identifier corresponds is a general authority, then the voice recognition is activated; and if the user authority to which the identifier corresponds is a special authority, then the voice recognition is skipped and the access control terminal is controlled to open the access control.

In another implementation of the present embodiment, the access control terminal may identify a plurality of mobile terminals in its monitored region. At this time, it should be firstly determined whether the plurality of mobile terminals belong to one and the same registered user. If yes, then locating any one of the mobile terminals is enough. If the plurality of the mobile terminals belong to different users, then the plurality of the mobile terminals should be located. When having successfully located the plurality of mobile terminals, it turns to a multi-user processing mode.

In detail, when the access control terminal may identify a plurality of mobile terminals in its monitored region, verifying the identified mobile terminal in the above step S130 also comprises:

obtaining the identifier of each mobile terminal and determining if the user information of the identifier of each mobile terminal is identical; and if yes, locating any one of the mobile terminals; and if not, then locating the plurality of the mobile terminals; and when having successfully located the plurality of mobile terminals, turning to a multi-user processing mode.

In the present implementation, a corresponding multi-user processing mode is set according to the application of the access control terminal. When the access control terminal is used in an application of checking attendance, the multi-user processing mode is: controlling the access control terminal to play identification prompt sounds, obtaining user responding voice of each successfully located user successively, recording the time of obtaining the corresponding user responding voice, at the same time verifying the obtained user responding voice of one of the successfully located user, and controlling the opening or closing of the access control based on the voice verification result. This kind of processing method verifies the identities of multiple users coming at the same time, distinguishes and records the identity of each person and thus meets the requirement of checking attendance.

When the access control terminal is used in an application requiring high security level, the multi-user processing mode is: controlling the access control terminal to play prompt sounds for performing identification one by one and obtaining the user responding voice of just one of the successfully located users at a time; after the verification of the user responding voice of this successfully located user is done, controlling the access control terminal to obtain the user responding voice of another successfully located user until finishing the voice recognition of all the successfully located users. This kind of processing method verifies the identities of a plurality of users coming at the same time one by one. By distinguishing each person's identity, it is guaranteed that each person entering into and exiting from the room is an authorized person and achieve a high security level.

When the control access is used in other applications, the multi-user processing mode is: controlling the access control terminal to play identification prompt sounds, obtaining the user responding voice of just one of the successfully located users, verifying the user responding voice of this successfully located user, and controlling the opening or closing of the access control based on the voice verification result. This kind of processing method verifies the identity of just one of a plurality of users coming at the same time and can meet the requirement of managing special authority.

In another implementation of the embodiment, in the above step S120, controlling the access control terminal to identify a mobile terminal within the monitored region by short-range wireless communication function of the mobile terminal is embodied as:

controlling the access control terminal to transmit a broadcasting signal including the access control terminal information at each time interval; and upon obtaining a wireless responding signal fed back by the mobile terminal to the access control terminal relative to the broadcasting signal by the short-range wireless communication function, identifying the mobile terminal.

Then in the step S140, when the verification of the user identity information is approved, locating the user to which the mobile terminal belongs is embodied as:

calculating a real-time distance between the user to which the mobile terminal belongs and the access control terminal based on the intensity of the wireless responding signal of the mobile terminal; and determining whether the user to which the mobile terminal belongs enters into a target zone of the access control terminal based on the calculated real-time distance between the user to which the mobile terminal belongs and the access control terminal, and when the user to which the mobile terminal belongs enters into the target zone of the access control terminal, successfully locating the user to which the mobile terminal belongs.

Because when different BLE devices on the user's side are located at the same position in the monitored region of the access control terminal, the intensity of the wireless responding signal obtained by the access control access may be different. Therefore, it is also possible to calculate the real-time distance between the user and the access control terminal by the infrared function of the access control terminal.

In this implementation, it is possible to calculate the distance in real time (the real-time distance) between the user and the access control terminal by the intensity of the wireless responding signal obtained by the access control access; it is also possible to calculate the distance in real time between the user and the access control terminal by the infrared function of the access control terminal; and it is also possible to calculate the distance in real time between the user and the access control terminal by the intensity of the wireless responding signal obtained in combined with the infrared function of the access control terminal.

Embodiment II

In this embodiment, the access control of the access control terminal is controlled by the method of access control monitoring in Embodiment I.

When the opening and closing of the access control of the access control terminal is controlled in this embodiment, the users' identities are logged in at first. That is, by matching with a mobile terminal on a user's side provided with the function of short-range wireless communication, and establishing a verification list recording the user identity information, the user's identity is logged in.

It should be noted that, the user identity information in this embodiment includes identifiers for uniquely indicating the mobile terminals, user voice information and user authority information, wherein the identifiers of the mobile terminals are the UUID of the mobile terminals.

Figure 2:
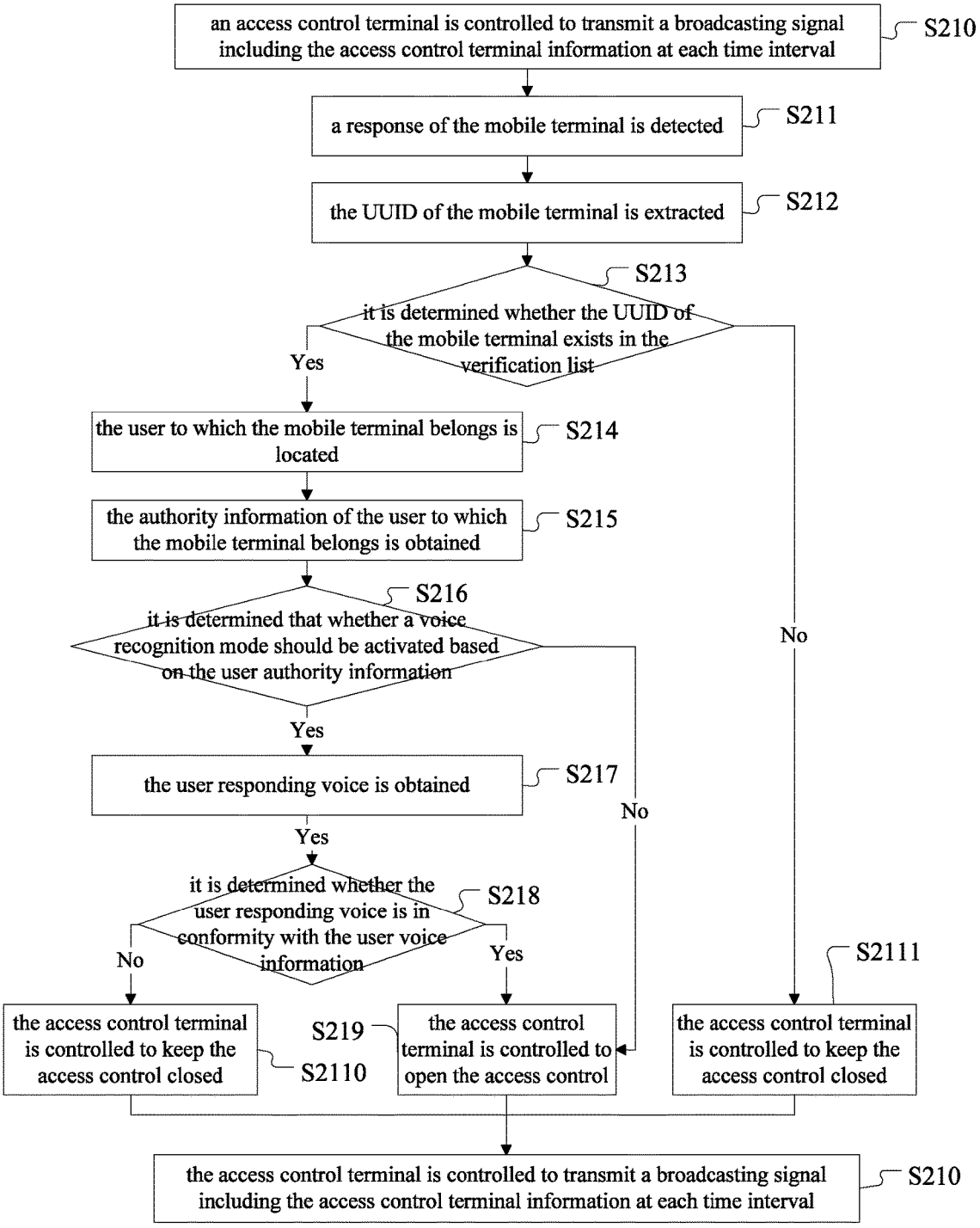
FIG. 2 is a flow diagram for a method for access control monitoring provided by Embodiment II of the present disclosure at the time when entering into a room.
Figure 3:
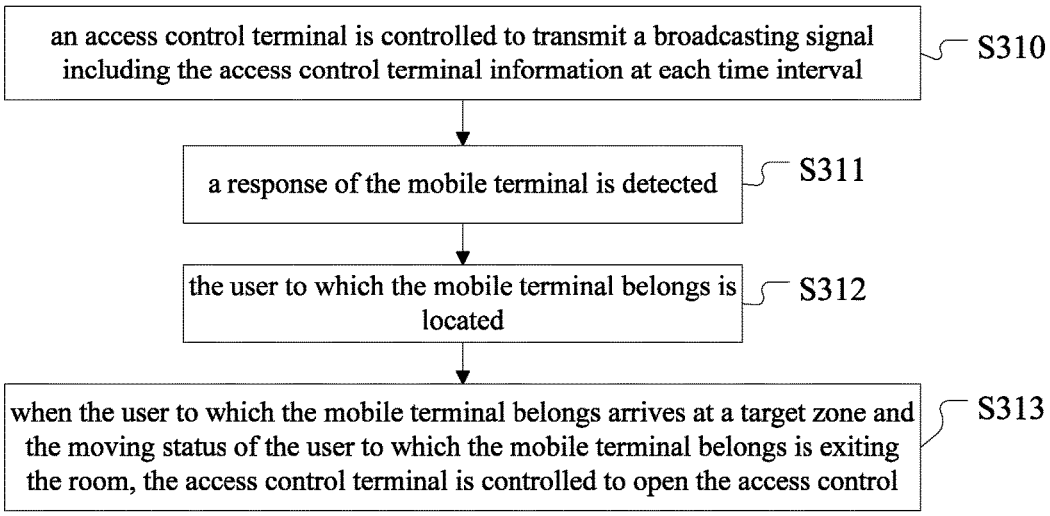
FIG. 3 is a flow diagram for a method for access control monitoring provided by Embodiment II of the present disclosure at the time when exiting the room.

The monitoring method for the access control terminal adopted by the system for access control monitoring in this embodiment is shown in FIGS. 2 and 3. The system for the access control monitoring can be implemented by a central computer in practice.

FIG. 2 is a flow diagram for a method for access control monitoring provided by this embodiment at the time when entering into a room, and FIG. 3 is a flow diagram for a method for access control monitoring provided by this embodiment at the time when exiting the room. The logic of opening the access of the present disclosure will be explained by the method of the access control monitoring as shown in FIGS. 2 and 3 in this embodiment.

In detail, the method for access control monitoring at the time when entering into the room is shown in FIG. 2 and the method for the access control monitoring in FIG. 2 is as follows:

S210, the access control terminal is controlled to transmit a broadcasting signal including the access control terminal information at each time interval and waits for the response of a nearby mobile terminal.

S211, the response of the mobile terminal is detected.

In this step, upon obtaining the wireless responding signal fed back by the mobile terminal to the access control terminal relative to the broadcasting signal by the short-range wireless communication function, the responding mobile terminal is detected.

S212, the UUID of the mobile terminal is extracted from the wireless responding signal obtained.

It should be noted that when a plurality of responding mobile terminal are detected in S211, UUID of each mobile terminal is extracted in this step.

S213, it is determined whether the UUID of the above mobile terminal exists in the verification list. If it exists, then perform step S214; otherwise perform S2111.

It should be noted that when obtaining the UUIDs of a plurality of mobile terminals, it is determined whether the user information of the UUIDs of the plurality of the mobile terminals is identical. If yes, locating any one of the mobile terminals is enough; and if not, then locate the plurality of the mobile terminals; and when having successfully located the plurality of mobile terminals, it turns to a multi-user processing mode.

S214, the user to which the mobile terminal belongs is located.

S215, when the user to which the mobile terminal belongs arrives at a target zone and the moving status of the user to which the mobile terminal belongs is entering into a room, the authority information of the user to which the mobile terminal belongs is obtained.

S216, it is determined that whether the voice recognition mode should be activated based on the user authority information. If the user authority of the user to which the mobile terminal belongs is a general authority, then perform step S217; and if the user authority of the user to which the mobile terminal belongs is a special authority, then perform step S219.

S217, the voice recognition mode is activated and the user responding voice is obtained.

S218, it is determined whether the user responding voice is in conformity with the user voice information. If yes, then perform step S219; otherwise, perform step S2110.

S219, the access control terminal is controlled to open the access control and closes the access control after the user leaves, and then the method returns to step S210.

S2110, the access control terminal is controlled to keep the access control closed and the user is informed of the failure of the voice recognition, and the method returns to the step S210.

S2111, the access control terminal is controlled to play the prompt sounds that the user is not verified and keep the access control closed, and the method returns to the step S210.

The method for access control monitoring at the time when exiting the room is shown in FIG. 3 and the method for the access control monitoring in FIG. 3 is as follows:

S310, the access control terminal is controlled to transmit a broadcasting signal including the access control terminal information at each time interval and waits for a response of a nearby mobile terminal.

S311, the response of the mobile terminal is detected.

In this step, upon obtaining the wireless responding signal fed back by the mobile terminal to the control access terminal relative to the broadcasting signal by the short-range wireless communication function, the responding mobile terminal is detected.

S312, the user to which the mobile terminal belongs is located.

It should be noted that when a plurality of responding mobile terminals are detected in S311, preferably in this step it can be done by locating the user to which anyone of the mobile terminals belongs.

S313, when the user to which the mobile terminal belongs arrives at the target zone and the moving status of the user to which the mobile terminal belongs is exiting the room, the access control terminal is controlled to open the access control and close the access control after the user leaves.

Embodiment III

Based on the technical concepts same with the Embodiments I or II, this embodiment provides a system for access control monitoring which is suitable for a control region including a plurality of rooms.

Figure 4:
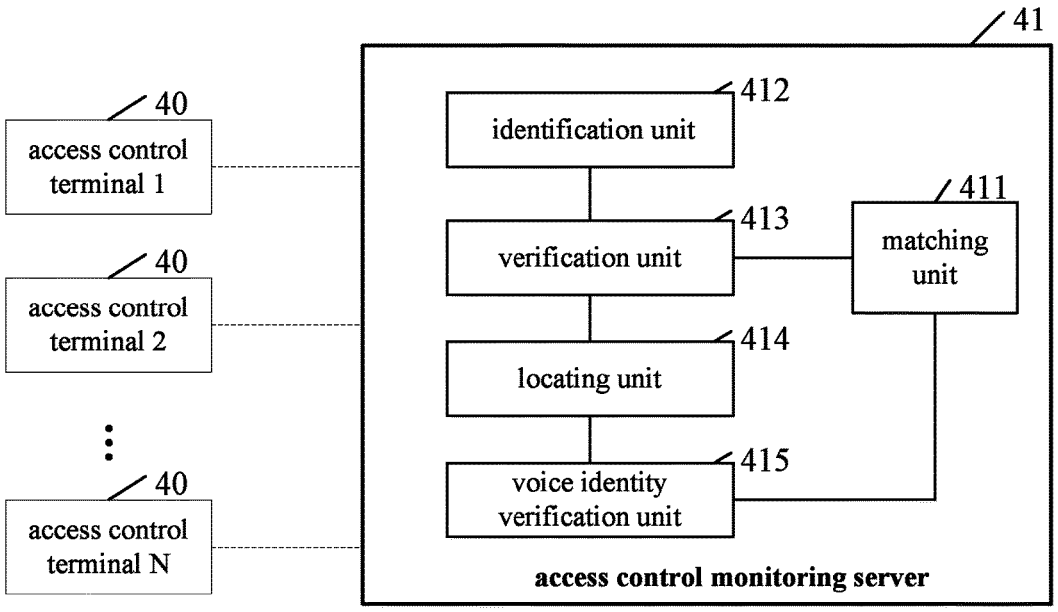
FIG. 4 is a schematic structural view for a system for access control monitoring provided by Embodiment I of the present disclosure.

FIG. 4 is a schematic structural view for a system for access control monitoring provided by this embodiment. As shown in FIG. 4, the system for the access control monitoring in this embodiment includes an access control terminal 40 provided in each room and an access control monitoring server 41;

the access control monitoring server 41 is for the user identity login, data exchange with each access control terminal 40 and controlling each access control terminal 40; and the access control terminal 40 is for, under the control of the access control monitoring server 41, broadcasting information into the environment, playing prompt sounds to the users, exchanging data with the access control monitoring server 41, coordinating with the access control monitoring server 41 in identification and locating of the mobile terminal and voice recognition of the user to which the mobile terminal belongs.

In detail, the access control monitoring server 41 comprises: a matching unit 411, an identification unit 412, a verification unit 413, a locating unit 414 and a voice identity verification unit 415.

The matching unit 411 is for matching with a mobile terminal provided with function of short-range wireless communication on a user's side and establishing a verification list recording the user identity information.

The identification unit 412 is for, when the monitoring function is on, controlling the access control terminal to identify a mobile terminal within a monitored region by the short-range wireless communication function of the mobile terminal.

The verification unit 413 is for, when the mobile terminal is identified, verifying user identity information of the user to which the mobile terminal belongs.

The locating unit 414 is for, when the verification of the user identity information is approved, locating the user to which the mobile terminal belongs.

The voice identity verification unit 415 is for activating a voice recognition mode for a successfully located user, controlling the access control terminal to play identification prompt sounds to the user and verifying the identity of the user by the user responding voice returned by the access control terminal, and controlling the opening or closing of the access control based on the voice verification result.

The access control monitoring system of the embodiment combines the short-range wireless communication function and voice recognition function to replace the traditional verification methods for access control such as swiping cards, fingerprints or human face identification. By the short-range wireless communication function in the mobile device, a user's mobile device can be detected and located without the user's perception. When the mobile device is successfully identified and the user to which the mobile terminal belongs arrives at a target zone, the voice recognition mode is activated. The user's identity is verified by automatic voice recognition.

Compared with existing verification methods of touch-type (such as swiping cards or fingerprints) and of human face type, the verification method for the user's identity in the access control system of this embodiment is more convenient and safer, and can effectively enhance the user's experience.

In one implementation of the embodiment, the access control system of FIG. 4 also comprises a control unit;

the locating unit 414 is to identify the moving status of the mobile terminal when locating the user to which the mobile terminal belongs;

the voice identity verification unit 415 is to activate the voice recognition mode when the locating unit 414 identifies that the moving status of the mobile terminal is entering into a room; and the control unit is to control the access control terminal 40 to open the access control and close the access control after the user leaves when the locating unit 414 identifies that the moving status of the mobile terminal is exiting the room.

In another implementation of this embodiment, the user identity information in the matching unit 411 includes an identifier for uniquely indicating the mobile terminal.

The verification unit 413 is for obtaining the identifier of the mobile terminal from the wireless response signal transmitted by the mobile terminal, and if the identifier exists in the verification list, approving the verification of the user identity information of the user to which the mobile terminal belongs; and if the identifier does not exist in the verification list, not approving the verification of the user identity information of the user to which the mobile terminal belongs; and wherein the wireless response signal is a feedback signal transmitted by the mobile terminal relative to the broadcasting signal transmitted by the access control terminal and the broadcasting signal is a signal sent by the access control terminal for identifying the mobile terminal.

It should be noted that the matching unit 411 in this implementation is a device with short-range wireless communication function same with the mobile terminal so as to verify or detect the identifier of the mobile terminal on the user's side when matching with the mobile terminal on the user's side.

Obviously, the user identity information in the matching unit 411 also includes user voice information;

the voice identity verification unit 415 is for controlling the access control terminal to play identification prompt sounds to the user and obtaining the user responding voice returned from the access control terminal; and determining whether the obtained user responding voice is in conformity with the user voice information in the verification list; controlling access control terminal to open the access control if they are identical; and controlling the access control terminal to keep the access control closed and inform the failure of the user voice verification if they are not identical.

It should be noted that the matching unit 411 in this implementation has a voice input device so as to input the user voice information.

Furthermore, in consideration of the factors such as the application and management of the control access terminal, the authorities of the users being verified may be different, that is, the user identity information recorded in the verification list may also include user authority information.

When the user identity information in the matching unit 411 also includes user authority information, the voice identity verification unit 415 is configured to obtain the user authority information to which the identifier of the mobile terminal corresponds; and to determine whether the voice recognition mode should be activated based on the user authority information to which the identifier corresponds; and if the user authority to which the identifier corresponds is a general authority, then activate the voice recognition mode; if the identifier to which the identifier corresponds to is a special authority, then skip the voice recognition and drive the control unit to control the access control terminal to open the access control.

In another implementation of the embodiment, when the locating unit 414 successfully locates a plurality of users, the voice identity verification unit 415 enters into a multi-user processing mode, the voice identity verification unit 415 enters into a multi-user processing mode, controls the access control terminal to play identification prompt sounds, successively obtains user responding voice of each successfully located user, records the time of obtaining the corresponding user responding voice, at the same time verifies user responding voice of one of the successfully located users, and controls the opening or closing of the access control based on the voice verification result; or the voice identity verification unit 415 controls the access control terminal to play identification prompt sounds, obtains the user responding voice of one of the successfully located users, verifies the user responding voice of this successfully located user, and controls the opening or closing of the access control based on the voice verification result; or the voice identity verification unit 415 controls the access control terminal to play prompt sound for performing identification one by one, obtains the user responding voice of just one of the successfully located users; after finishing the verification of the user responding voice of this successfully located user, controls the access control terminal to obtain the user responding voice of another successfully located user until finishing the voice recognition of all successfully located users.

In another implementation of the embodiment, the identification unit 412 is for driving the control unit to control the access control terminal to transmit a broadcasting signal including the access control terminal information at each time interval; and upon obtaining the wireless responding signal fed back by the mobile terminal to the access control terminal relative to the broadcasting signal by the short-range wireless communication function, identifying the mobile terminal.

Then the locating unit 414 is for calculating a real-time distance between the user to which the mobile terminal belongs and the access control terminal based on the intensity of the wireless responding signal of the mobile terminal; and determining whether the user enters into the target zone of the access control terminal based on the calculated real-time distance, and when the user to which the mobile terminal belongs enters into the target zone of the access control terminal, successfully locating the user to which the mobile terminal belongs.

Because when different BLE devices on the user's side are located at the same positions in the monitored region of the access control terminal, the intensity of the wireless responding signal obtained by the access control terminal may be different. Therefore, it is also possible for the infrared function of the access control terminal to calculate the distance in real time between the user and the access control terminal.

Specifically, the locating unit 41 is used for driving the control unit to control the access control terminal to activate the infrared function; and the locating unit 41 calculates the distance in real time between the user to which the mobile terminal belongs and the access control terminal according to the intensity of the wireless responding signal of the mobile terminal and/or the infrared signal transmitted by the access control terminal.

The short-range wireless communication function of the mobile terminal in this embodiment is preferably Bluetooth low power consumption function and the identifier of the mobile terminal is preferably Bluetooth UUID.

In summary, the present disclosure provides a method and system for access control monitoring. The present disclosure combines the short-range wireless communication function and voice recognition function to replace the traditional verification methods for access control such as swiping cards, fingerprints or human face identification. By the short-range wireless communication function in the mobile terminal, a user's mobile terminal can be detected and located without the user's perception. When the mobile terminal is successfully identified and the user to which the mobile terminal belongs arrives at the target zone, the voice recognition mode is activated. The user's identity is verified by automatic voice recognition. Compared with existing verification methods of touch-type (such as swiping cards or finger prints) and of human face type, the technical solutions in the present disclosure are more convenient and safer, and can effectively enhance the user's experience.

The above described is merely best embodiments of the present disclosure and is not intended to limit the protection scope of the present disclosure. Any modification, equivalent alternation and development made within the scope and principle of the present disclosure fall within the protection scope of the present disclosure.

The invention claimed is:

1. A method for access control monitoring, suitable for a control region including a plurality of rooms, wherein each room is provided with an access control terminal and the method for access control monitoring comprises:

matching with a mobile terminal on a user's side provided with a function of short-range wireless communication, and establishing a verification list recording user identity information;

when monitoring function is on, controlling the access control terminal to identify the mobile terminal within a monitored region by the short-range wireless communication function of the mobile terminal;

when the mobile terminal is identified, verifying the user identity information of the user to which the mobile terminal belongs;

when the verification of the user identity information is approved, locating the user to which the mobile terminal belongs; and for a successfully located user, activating a voice recognition mode, controlling the access control terminal to play identification prompt sounds to the user and verifying the identity of the user by user responding voice returned by the access control terminal, and controlling opening or closing of the access control based on the voice verification result.

2. The method for access control monitoring according to claim 1, wherein the locating the user to which the mobile terminal belongs comprises:

identifying moving status of the mobile terminal;

then for a successfully located user, activating a voice recognition mode comprises:

when the moving status of the mobile terminal is entering into a room, activating the voice recognition mode; and when the moving status of the mobile terminal is exiting the room, controlling the access control terminal to open the access control and close the access control after the user leaves.

3. The method for access control monitoring according to claim 1, wherein the user identity information includes an identifier for uniquely indicating the mobile terminal; and wherein when the mobile terminal is identified, verifying the user identity information of the user to which the mobile terminal belongs specifically comprises:

obtaining the identifier of the mobile terminal from an wireless response signal transmitted by the mobile terminal, and if the identifier exists in the verification list, approving the verification of the user identity information of the user to which the mobile terminal belongs; and if the identifier does not exist in the verification list, not approving the verification of the user identity information of the user to which the mobile terminal belongs; and wherein the wireless response signal is a feedback signal transmitted by the mobile terminal relative to a broadcasting signal transmitted by the access control terminal, and the broadcasting signal is a signal sent by the access control terminal for identifying the mobile terminal.

4. The method for access control monitoring according to claim 3, wherein the user identity information also includes user authority information and the for a successfully located user, activating a voice recognition mode further comprises:

obtaining user authority information to which the identifier of the mobile terminal corresponds; and determining whether the voice recognition mode should be activated based on the user authority information to which the identifier corresponds; and if the user authority to which the identifier corresponds is a general authority, then activating the voice recognition mode; and if the user authority to which the identifier corresponds is a special authority, then skipping the voice recognition and controlling the access control terminal to open the access control.

5. The method for access control monitoring according to claim 1, wherein when several users are successfully located, the activating a voice recognition mode, controlling the access control terminal to play identification prompt sounds to the user and verifying the identity of the user by the user responding voice returned by the access control terminal comprises:

entering into a multi-user processing mode, controlling the access control terminal to play identification prompt sounds, successively obtaining user responding voice of each successfully located user, recording the time of obtaining corresponding user responding voice, at the same time verifying user responding voice of one of the successfully located user, and controlling the opening or closing of the access control based on the voice verification result; or controlling the access control terminal to play identification prompt sounds, obtaining the user responding voice of one of the successfully located users, verifying the user responding voice of this successfully located user, and controlling the opening or closing of the access control based on the voice verification result; or controlling the access control terminal to play prompt sounds for performing identification one by one, obtaining the user responding voice of just one of the successfully located users; after finishing the verification of the user responding voice of this successfully located user, controlling the access control terminal to obtain the user responding voice of another successfully located user until finishing the voice recognition of all the successfully located users.

6. The method for access control monitoring according to claim 1, wherein the controlling the access control terminal to identify a mobile terminal within a monitored region by short-range wireless communication function of the mobile terminal comprises:

controlling the access control terminal to transmit a broadcasting signal including the access control terminal information at each time interval; and upon obtaining a wireless responding signal fed back by the mobile terminal to the access control terminal relative to the broadcasting signal by the short-range wireless communication function, identifying the mobile terminal.

7. The method for access control monitoring according to claim 6, wherein when the verification of the user identity information is approved, locating the user to which the mobile terminal belongs specifically comprises:

calculating a real-time distance between the user to which the mobile terminal belongs and the access control terminal based on the intensity of the wireless responding signal of the mobile terminal and/or infrared function of the access control terminal; and determining whether the user enters into a target zone of the access control terminal based on the calculated real-time distance, and when the user to which the mobile terminal belongs enters into the target zone of the access control terminal, successfully locating the user to which the mobile terminal belongs.

8. The method for access control monitoring according to claim 6, wherein the short-range wireless communication function of the mobile terminal is Bluetooth low consumption function and the identifier is Bluetooth Universally Unique Identifier.

9. A system for access control monitoring, suitable for a control region including a plurality of rooms, wherein the system for access control monitoring includes an access control terminal provided in each room and an access control monitoring server, and wherein the access control monitoring server comprises:

a matching unit for matching with a mobile terminal on a user's side provided with a function of short-range wireless communication, and establishing a verification list recording user identity information;

an identification unit for, when the monitoring function is on, controlling the access control terminal to identify a mobile terminal within a monitored region by the short-range wireless communication function of the mobile terminal;

a verification unit for, when the mobile terminal is identified, verifying the user identity information of the user to which the mobile terminal belongs;

a locating unit for, when the verification of the user identity information is approved, locating the user to which the mobile terminal belongs; and a voice identity verification unit for activating a voice recognition mode for a successfully located user, controlling the access control terminal to play identification prompt sounds to the user and verifying the identity of the user by the user responding voice returned by the access control terminal, and controlling opening or closing of the access control based on the voice verification result.

10. The system for access control monitoring according to claim 9, wherein the access control system also comprises a control unit;

the locating unit is configured to identify moving status of the mobile terminal when locating the user to which the mobile terminal belongs;

the voice identity verification unit is configured to activate the voice recognition mode when the locating unit identifies that the moving status of the mobile terminal is entering into a room; and the control unit is configured to control the access control terminal to open the access control and close the access control after the user leaves when the locating unit identifies that the moving status of the mobile terminal is exiting the room.

11. The system for access control monitoring according to claim 9, wherein the user identity information in the matching unit includes an identifier for uniquely indicating the mobile terminal; and the verification unit is specifically for obtaining the identifier of the mobile terminal from a wireless response signal transmitted by the mobile terminal, and if the identifier exists in the verification list, approving the verification of the user identity information of the user to which the mobile terminal belongs; and if the identifier does not exist in the verification list, not approving the verification of the user identity information of the user to which the mobile terminal belongs; wherein the wireless response signal is a feedback signal transmitted by the mobile terminal relative to the broadcasting signal transmitted by the access control terminal, and the broadcasting signal is a signal sent by the access control terminal for identifying the mobile terminal.

12. The system for access control monitoring according to claim 11, wherein the user identity information in the matching unit also includes user authority information; and the voice identity verification unit is specifically configured to obtain the user authority information to which the identifier of the mobile terminal corresponds; and to determine whether the voice recognition mode should be activated based on the user authority information to which the identifier corresponds; and if the user authority to which the identifier corresponds is a general authority, then activate the voice recognition mode; and if the user authority to which the identifier corresponds to is a special authority, then skip the voice recognition and drive the control unit to control the access control terminal to open the access control.

13. The system for access control monitoring according to claim 9, wherein when the locating unit successfully locates a plurality of users, the voice identity verification unit is for entering into a multi-user processing mode, controlling the access control terminal to play identification prompt sounds, successively obtaining user responding voice of each successfully located user, recording the time of obtaining the corresponding user responding voice, at the same time verifying user responding voice of one of the successfully located users, and controlling the opening or closing of the access control based on the voice verification result; or the voice identity verification unit is for controlling the access control terminal to play identification prompt sounds, obtaining the user responding voice of one of the successfully located users, verifying the user responding voice of this successfully located user, and controlling the opening or closing of the access control based on the voice verification result; or the voice identity verification unit is for controlling the access control terminal to play prompt sound for performing identification one by one, obtaining the user responding voice of just one of the successfully located users; after finishing the verification of the user responding voice of this successfully located user, controlling the access control terminal to obtain the user responding voice of another successfully located user until finishing the voice recognition of all the successfully located users.

14. The system for access control monitoring according to claim 9, wherein the identification unit is configured to control the access control terminal to transmit a broadcasting signal including the access control terminal information at each time interval; and upon obtaining a wireless responding signal fed back by the mobile terminal to the access control terminal relative to the broadcasting signal by the short-range wireless communication function, identify the mobile terminal.

15. The system for access control monitoring according to claim 14, wherein the locating unit is for calculating a real-time distance between the user to which the mobile terminal belongs and the access control terminal based on the intensity of the wireless responding signal of the mobile terminal and/or infrared function of the access control terminal; and determining whether the user enters into a target zone of the access control terminal based on the calculated real-time distance, and when the user to which the mobile terminal belongs enters into the target zone of the access control terminal, successfully locating the user to which the mobile terminal belongs.

* * * * *